US011139108B2

(12) United States Patent
Bong et al.

(10) Patent No.: US 11,139,108 B2
(45) Date of Patent: Oct. 5, 2021

(54) COIL ELECTRONIC COMPONENT

(71) Applicant: SAMSUNG ELECTRO-MECHANICS CO., LTD., Suwon-si (KR)

(72) Inventors: Kang Wook Bong, Suwon-si (KR); Byeong Cheol Moon, Suwon-si (KR); Boum Seock Kim, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 525 days.

(21) Appl. No.: 16/181,722

(22) Filed: Nov. 6, 2018

(65) Prior Publication Data

US 2019/0362886 A1 Nov. 28, 2019

(30) Foreign Application Priority Data

May 28, 2018 (KR) ..... 10-2018-0060333

(51) Int. Cl.

| | |
|---|---|
| ***H01F 27/28*** | (2006.01) |
| ***H01F 27/34*** | (2006.01) |
| ***H01F 27/32*** | (2006.01) |
| ***H01F 41/04*** | (2006.01) |
| ***H01F 27/29*** | (2006.01) |

(52) U.S. Cl.

CPC ..... *H01F 27/34* (2013.01); *H01F 27/2804* (2013.01); *H01F 27/292* (2013.01); *H01F 27/327* (2013.01); *H01F 41/042* (2013.01); *H01F 2027/2809* (2013.01)

(58) Field of Classification Search

CPC ..... H01F 27/34; H01F 27/2804; H01F 27/327

USPC ..... 336/192, 200.232, 83

See application file for complete search history.

(56) References Cited

U.S. PATENT DOCUMENTS

2008/0157913 A1* 7/2008 Kim ..... H01F 17/0013 336/200
2008/0174398 A1* 7/2008 Hsu ..... H01F 17/0006 336/200
2009/0322458 A1* 12/2009 Lee ..... H01F 17/0006 335/299

(Continued)

FOREIGN PATENT DOCUMENTS

| | | | |
|---|---|---|---|
| JP | H09-252087 | A | 9/1997 |
| JP | 2010-016337 | A | 1/2010 |
| KR | 10-1999-0066108 | A | 8/1999 |

*Primary Examiner* — Shawki S Ismail
*Assistant Examiner* — Kazi S Hossain
(74) *Attorney, Agent, or Firm* — Morgan, Lewis & Bockius LLP

(57) ABSTRACT

A coil electronic component includes a body including a support member, an internal coil supported by the support member, and an encapsulant encapsulating the support member and the internal coil, and external electrodes disposed on an external surface of the body and connected to the internal coil, wherein the internal coil includes a plurality of coil patterns, each of the plurality of coil patterns includes a lower coil pattern in contact with the support member and an upper coil pattern on the lower coil pattern, a line width and a thickness of the lower coil pattern are uniform in along the internal coil, and a line width and a thickness of the upper coil pattern are increased in a direction from the center of the internal coil to the outermost portion of the internal coil.

18 Claims, 5 Drawing Sheets

(56) References Cited

U.S. PATENT DOCUMENTS

| | | | | |
|---|---|---|---|---|
| 2015/0170823 | A1* | 6/2015 | Jeong | C25D 5/022<br>336/200 |
| 2015/0340149 | A1* | 11/2015 | Lee | H05K 1/181<br>174/260 |
| 2017/0330674 | A1* | 11/2017 | Lee | H01F 5/00 |
| 2019/0103215 | A1* | 4/2019 | Jung | H01F 27/29 |

* cited by examiner

COIL ELECTRONIC COMPONENT

CROSS-REFERENCE TO RELATED APPLICATION

This application claims the benefit of priority to Korean Patent Application No. 10-2018-0060333 filed on May 28, 2018 in the Korean Intellectual Property Office, the disclosure of which is incorporated herein by reference in its entirety.

TECHNICAL FIELD

The present disclosure relates to a coil electronic component and, more particularly, to a thin film type power inductor.

BACKGROUND

As portable devices such as smartphones, tablet PCs, and the like, have been provided with high performance, display screens have increased in size, speeds of application processors (APs) have increased, and dual or quad cores have been used, resulting in an increase in power consumption, and thus, thin film type inductors largely used in DC-DC converters, noise filters, and the like, are required to be realized to have high inductance and low direct current (DC) resistance.

Magnetic flux generated by a coil is formed from the inside to the outside of the coil. In a case in which coils are equal in height, a magnetic flux bottleneck phenomenon occurs around the innermost coil wound outwardly from the inside to the outside, which needs to be improved.

SUMMARY

An aspect of the present disclosure may provide a coil electronic component in which a magnetic flux bottleneck phenomenon mainly occurs in the vicinity of an innermost coil.

According to an aspect of the present disclosure, a coil electronic component may include: a body including a support member, an internal coil supported by the support member, and an encapsulant encapsulating the support member and the internal coil, and external electrodes disposed on an external surface of the body and connected to the internal coil, in which the internal coil includes a plurality of coil patterns, each of the plurality of coil patterns includes a lower coil pattern in contact with the support member and an upper coil pattern on the lower coil pattern, a line width and a thickness of the lower coil pattern are uniform along the internal coil, and a line width and a thickness of the upper coil pattern are increased in a direction from the center of the internal coil to the outermost portion of the internal coil.

A cross-section of the upper coil pattern and a cross-section of the lower coil pattern may have a rectangular shape.

The lower coil pattern may include a seed layer and a plating layer.

A line width of the seed layer and a line width of the plating layer may be equal.

An insulating layer may be further disposed on a surface of the internal coil.

A line width of the upper coil pattern may be narrower than or equal to a line width of the lower coil pattern disposed therebelow.

The support member may include a through-hole and a via hole spaced apart from the through-hole.

The through-hole may be filled with the encapsulant.

The internal coil may include a first coil on one surface of the support member and a second coil on the other surface of the support member.

The first coil and the second coil may be symmetrical with respect to the support member.

According to another aspect of the present disclosure, a coil electronic component may include: a body including a support member, an internal coil supported by the support member, and an encapsulant encapsulating the support member and the internal coil; and external electrodes disposed on an external surface of the body and connected to the internal coil, in which the internal coil includes a plurality of coil patterns each having a cross-section in a step shape, an upper portion of each of the plurality of coil patterns, which is in a farther side from the support member, has a line width different than a line width at a lower portion of each of the plurality of coil patterns, which is in a closer side from the support member, the line width at the upper portion of each of the plurality of coil patterns increases in a direction from the center of the internal coil to the outermost portion of the internal coil, and a thickness of each of the plurality of coil patterns increases in the direction from the center of the internal coil to the outermost portion of the internal coil.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Hereinafter, exemplary embodiments in the present disclosure will be described in detail with reference to the accompanying drawings.

Hereinafter, a coil electronic component and a manufacturing method thereof according to an example of the present disclosure will be described, but the present disclosure is not limited thereto.

Figure 1:
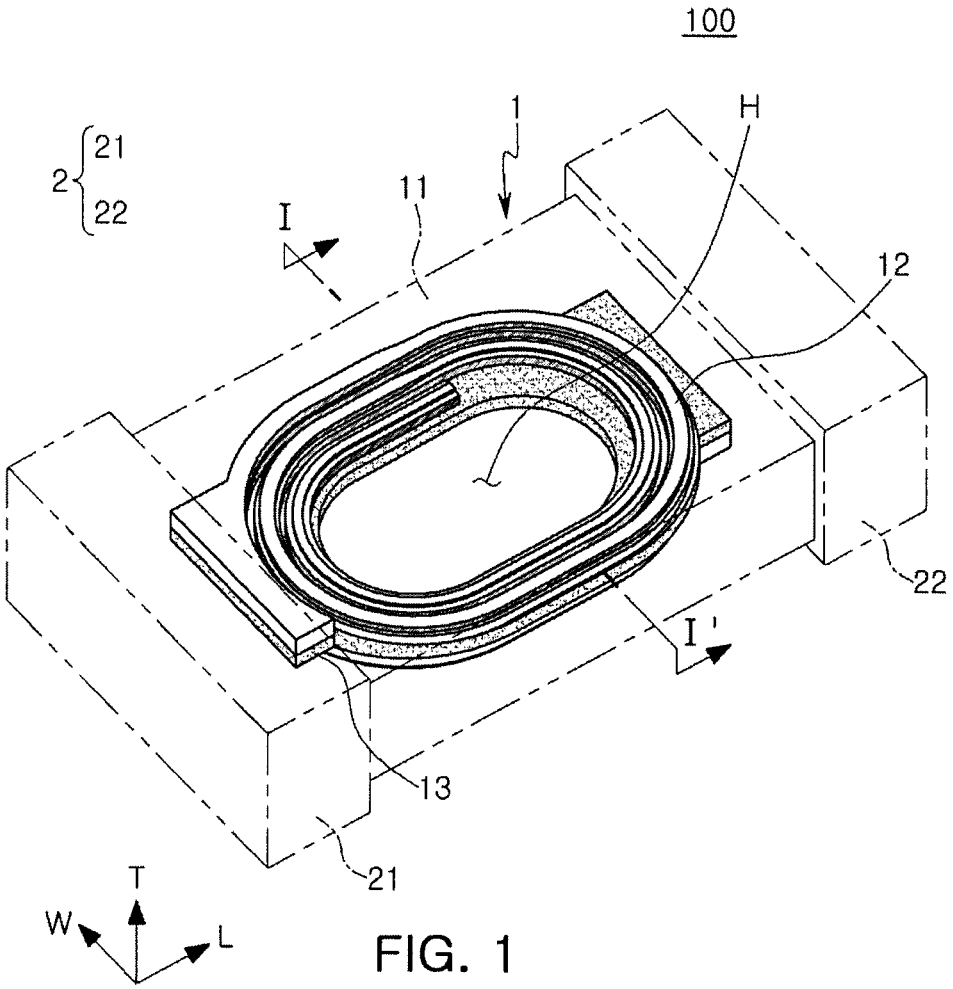
FIG. 1 is a schematic perspective view of a coil electronic component according to an exemplary embodiment in the present disclosure.
Figure 2:
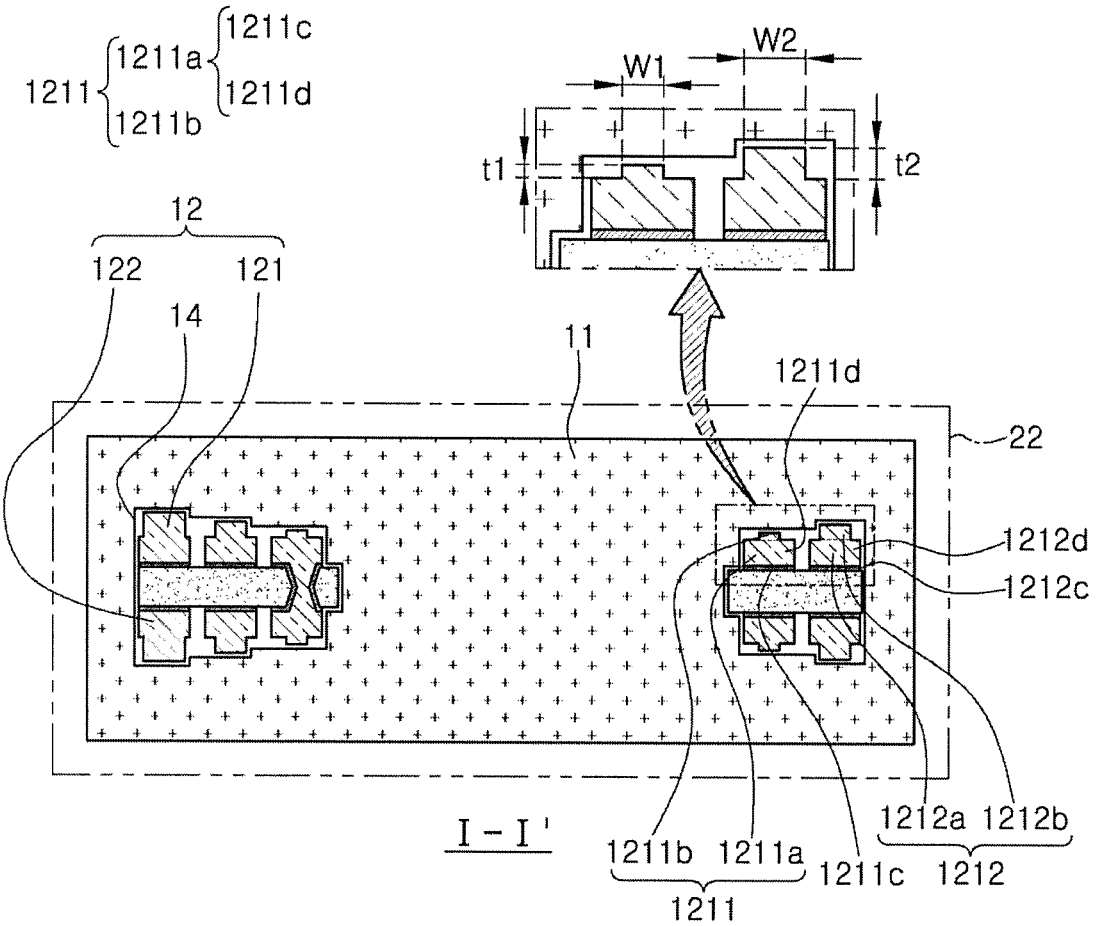
FIG. 2 is a cross-sectional view taken along line I-I' of FIG. 1.

FIG. 1 is a schematic perspective view of a coil electronic component 100 according to an example of the present disclosure, and FIG. 2 is a cross-sectional view taken along line I-I' of FIG. 1.

Referring to FIGS. 1 and 2, a coil electronic component 100 includes a body 1 and external electrodes 2.

The body 1 has an upper surface and a lower surface opposing each other in the thickness direction T, a first end surface and a second end surface opposing each other in the length direction L, and a first side surface and a second side surface opposing each other in the width direction W, having a hexagonal shape.

An encapsulant 11 determining an appearance of the body includes a material having magnetic properties. Specifically, the material may be prepared by dispersing ferrite particles or metal magnetic particles in a resin. The metal magnetic particles may include nickel (Ni), aluminum (Al), iron (Fe), and the like, but is not limited thereto.

A support member 13 and an internal coil 12 are sealed by the encapsulant 11. The support member 13 supports the internal coil 12 and serves to facilitate formation of the internal coil 12. The support member 13 may include a material having insulating properties. The support member 13 may be formed of a known copper clad laminate (CCL) substrate, or a PID resin, an ABF film, or the like, may be used by those skilled in the art if necessary.

An insulating layer 14 for preventing a short circuit between magnetic materials in the encapsulant 11 is formed on a surface of the internal coil 12, and here, an insulating resin having excellent insulating properties and moldability may be used without a limitation.

A through-hole H is formed at the center of the support member 13 and the inside of the through-hole is filled with the encapsulant 11 to make flow of magnetic flux generated by the internal coil 12 smooth to improve magnetic permeability of the coil electronic component. A via hole V is spaced apart from the through-hole H. The via hole V is a space for a via connecting a first coil 121 disposed on one surface of the support member 13 and a second coil 122 disposed on the other surface of the support member 13. Thus, the via hole V is filled with a conductive material.

The internal coil 12 includes a first coil 121 on one surface of the support member 13 and a second coil 122 on the other surface of the support member 13. The first coil 121 and the second coil 122 are symmetrical with respect to the support member 13. Therefore, since the contents of the first coil 121 may be applied to the second coil 122 as is, only the first coil 121 will be described for the purposes of description and a separate description of the second coil 122 will be omitted.

The first coil 121 includes a plurality of coil patterns 1211 and 1212. The coil patterns 1211 and 1212 are connected to each other and have a spiral shape that is wound a plurality of times when viewed from an upper surface of the coil electronic component.

The plurality of coil patterns 1211 and 1212 of the first coil 121 include lower coil patterns 1211*a* and 1212*a* and upper coil patterns 1211*b* and 1212*b*, respectively.

The upper coil patterns 1211*b* and 1212*b* are disposed on the lower coil patterns 1211*a* and 1212*a*. Here, a line width and thickness of the lower coil patterns 1211*a* and 1212*a* are kept substantially uniform along the internal coil 12. In addition, the lower coil patterns 1211*a* and 1212*a* substantially have a rectangular shape. The lower coil patterns 1211*a* and 1212*a* are formed of at least two layers, and, among the two layers, seed layers 1211*c* and 1212*c* are in direct contact with the support member 13 and act as basic layers of the coil patterns 1211 and 1212. The seed layers 1211*c* and 1212*c* are thin conductive layers and may have a thickness ranging from about 2 μm to 10 μm. Plating layers 1211*d* and 1212*d* are disposed on the seed layers 1211*c* and 1212*c*, respectively, and a line width of the plating layers 1211*d* and 1212*d* is substantially equal to a line width of the seed layers 1211*c* and 1212*c*. In addition to the seed layers 1211*c* and 1212*c* and the plating layers 1211*d* and 1212*d*, the lower coil patterns 1211*a* and 1212*a* may further include a plating layer (not shown) , which may be appropriately designed and changed by those skilled in the art as necessary.

An aspect ratio of the basic internal coil may be secured by the lower coil patterns 1211*a* and 1212*a*. Since the upper coil patterns 1211*b* and 1212*b* are further grown on upper surfaces of the lower coil patterns 1211*a* and 1212*a*, the thickness of the lower coil is generally smaller than a final thickness of the internal coil.

Referring to a line width w1 and a thickness t1 of the upper coil patterns 1211*b* and 1212*b* formed on the lower coil patterns 1211*a* and 1212*a*, the line width w1 and the thickness t1 of the first upper coil pattern 1211*b* are different from a line width w2 and a thickness t2 of the second upper coil pattern 1212*b*. The first upper coil pattern 1211*b* is defined as a coil pattern closer to the center of a core of the coil, and the second upper coil is defined as a coil pattern adjacent to the first upper coil pattern 1211*b* and close to the body 1. Since the thickness t1 of the first upper coil pattern 1211*b* is smaller than the thickness t2 of the second upper coil pattern 1212*b*, a bottleneck phenomenon of magnetic flux occurring in the vicinity of the innermost coil pattern may be improved.

Meanwhile, the line width w1 of the first upper coil pattern 1211*b* is smaller than the line width w2 of the second upper coil pattern 1212*b*. Since the line width of the first upper coil pattern 1211*b* is smaller than that of the second upper coil pattern 1212*b*, it is easy to differentiate between the thicknesses of the first and second upper coil patterns 1211*b* and 1212*b*.

According to the structure of the internal coil, since the line widths and the thicknesses of the coil are differentiated along the internal coil through the upper coil patterns, while the aspect ratio of the internal coil is stably significantly increased through the lower coil patterns, the occurrence of a bottleneck phenomenon of magnetic flux may be prevented. As a result, the coil electronic component may have improved impedance characteristics and the DC-bias characteristics as compared with a coil electronic component having the same size condition.

FIG. 3 illustrates a manufacturing process for manufacturing the coil component 100 described in FIGS. 1 and 2, and here, the coil component 100 is not necessarily manufactured only by the manufacturing process described in FIG. 3.

Figure 3A:
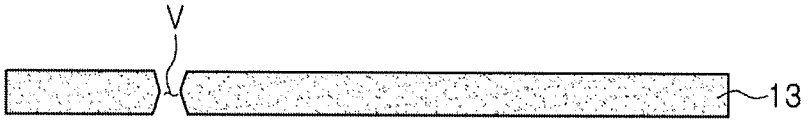
FIGS. 3A through 3I illustrate an example of a process of manufacturing the coil electronic component of FIG. 1.

Referring to FIG. 3A, the support member 13 on which a via hole V is processed is prepared. A thickness of the support member 13 may be appropriately adjusted within a range of 5 μm to 60 μm by those skilled in the art as necessary.

Figure 3B:
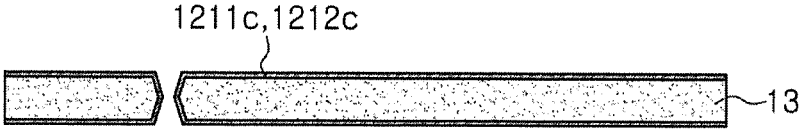

Referring to FIG. 3B, the seed layers 1211*c* and 1212*c* covering even all the side surfaces of the via hole V are formed. A method of forming the seed layers is not limited and a method of forming the seed layers appropriate for a design of those skilled in the art, such as sputtering, chemical copper plating, or the like, may be selected.

Figure 3C:
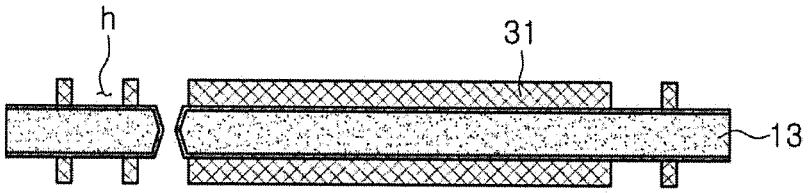

Referring to FIG. 3C, the patterned first dry film 31 is stacked. The patterned first dry film 31 includes a plurality of openings h, and line widths of the openings are substantially equal.

Figure 3D:
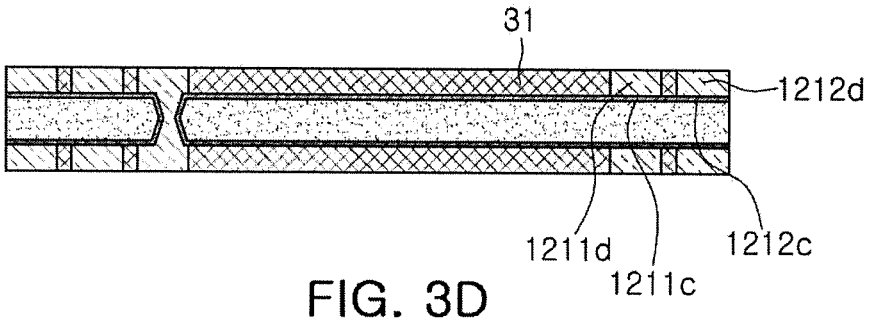

Thereafter, referring to FIG. 3D, the inside of the openings h of the first dry film 31 are filled with plating layers 1211*d* and 1212*d* among the lower coil patterns. Here, general electroplating or electroless plating may be utilized without a limitation, and since the plating layers 1211*d* and 1212*d* fill the previously prepared openings, the plating layers 1211*d* and 1212*d* have a rectangular cross-sectional shape and maintained in uniform line width and thickness.

Figure 3E:
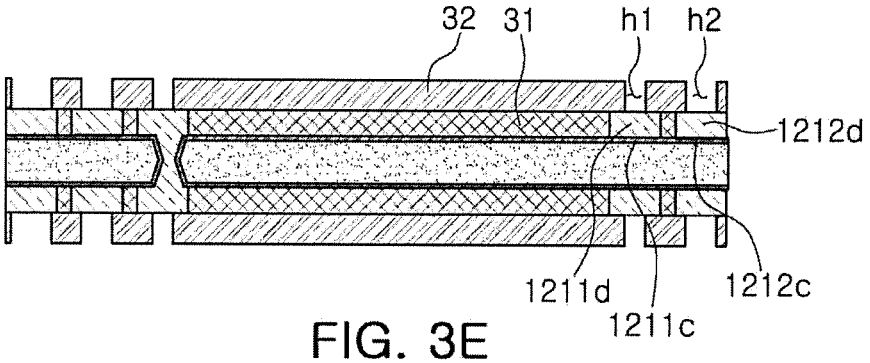

Referring to FIG. 3E, an additional second dry film 32 is stacked on the first dry film 31. The second dry film 32 is also patterned to include openings h1 and h2, and here, line widths of the openings h1 and h2 are different from each other. Specifically, a line width of the opening h1 forming the innermost coil pattern is narrower than a line width of the opening h2 forming a coil pattern adjacent thereto. In this manner, the line width of the upper coil pattern is gradually increased in the winding direction from the center of the internal coil 12 to the outermost portion of the internal coil 12.

Figure 3F:
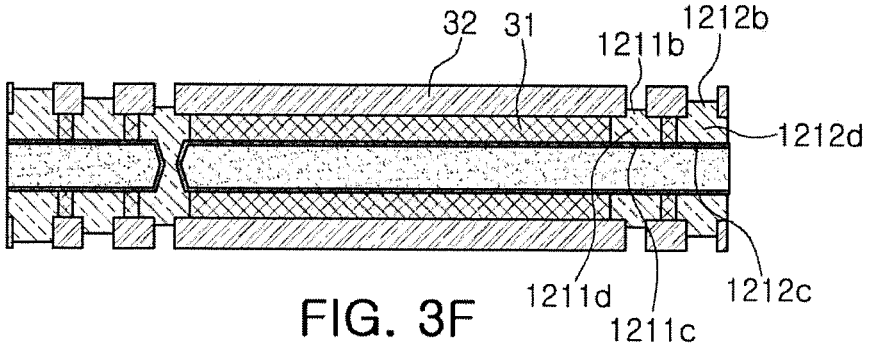

Referring to FIG. 3F, an upper coil pattern filling the inside of the openings h1 and h2 of the second dry film is formed. Since the line widths of the openings h1 and h2 increase along the winding direction of the internal coil 12, a line width of the upper coil patterns filling the inside also increases along the winding direction of the internal coil 12.

Figure 3G:
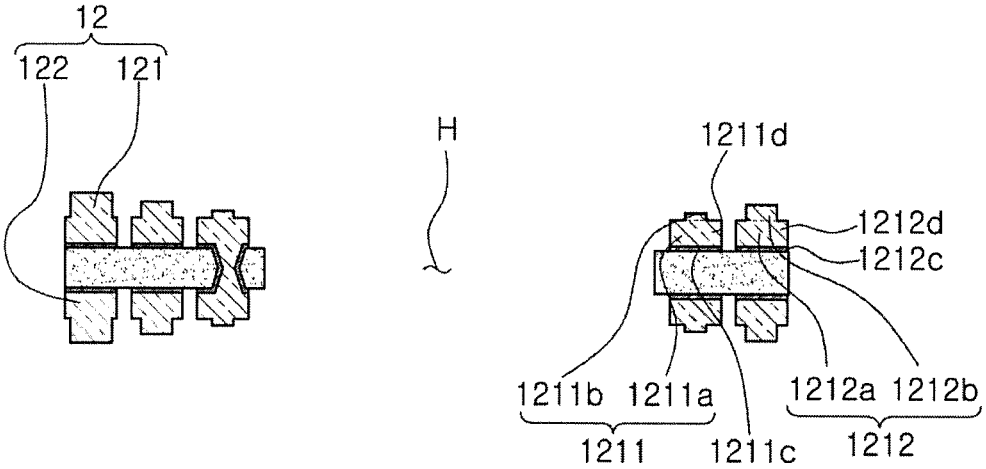

Thereafter, referring to FIG. 3G, the first and second dry films 31 and 32 and the seed layers 1211*c* and 1212*c* disposed under the first dry film are removed, and a through-hole H is formed in a portion corresponding to the center of the support member 13.

Here, a method of removing the first and second dry films 31 and 32 is not limited and a chemical removing method using a chemical solution capable of easily etching the corresponding dry film or a mechanical removing method may be utilized without a limitation.

The removal of the seed layers disposed under the first dry film is intended to prevent a short circuit between the adjacent coil patterns. The method of removing the seed layer maybe appropriately set according to a material constituting the seed layer. For example, the seed layers may be removed through a laser or chemical etching.

In addition, a drill or a laser may be used to form the through-hole H of the support member 13, but the present disclosure is not limited thereto.

Figure 3H:
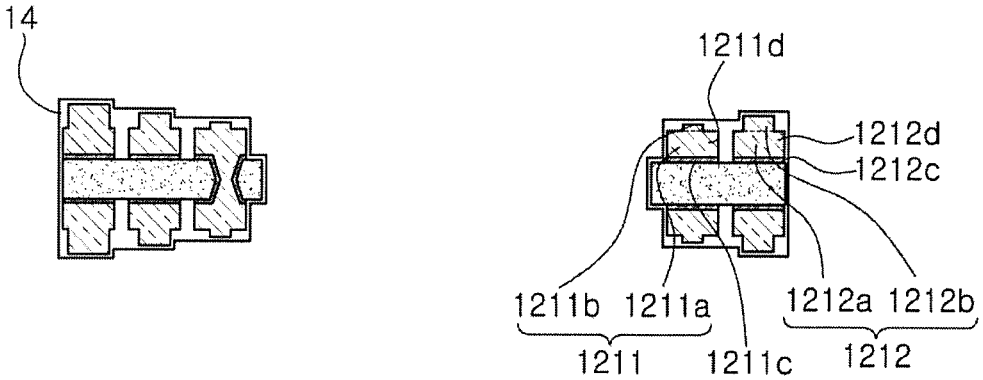

Next, FIG. 3H illustrates a process of forming an insulating layer 14 on a surface of the formed internal coil 12, and a short circuit may occur between the internal coil 12 and an encapsulant 11 to be applied thereafter due to the insulating layer 14. The forming of the insulating layer 14 may be performed by known chemical vapor deposition (CVD) but is not limited thereto.

Figure 3I:
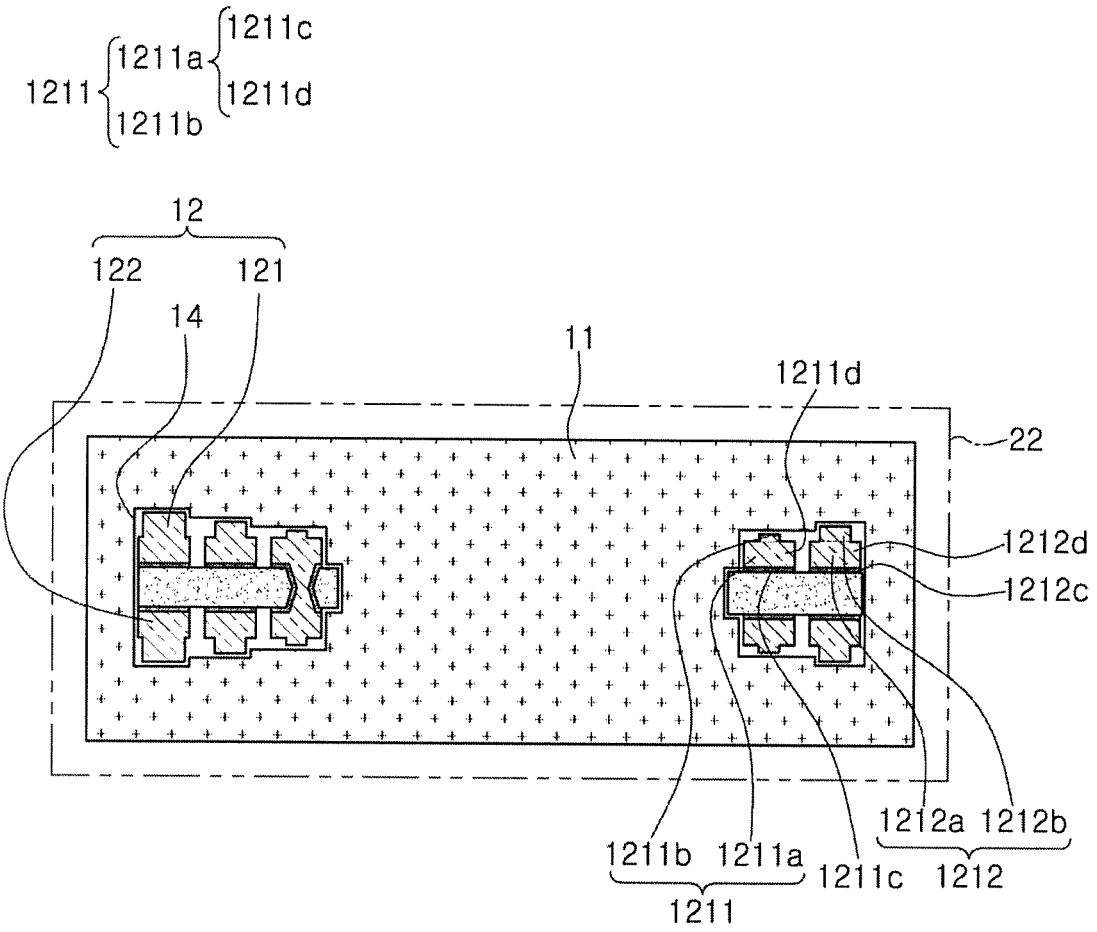

Finally, FIG. 3I illustrates a finishing process of forming a coil electronic component, during which an encapsulant 11 is applied, body insulation is formed, and external electrodes connected to lead portions of the internal coil 12 are formed.

Except for the above description, a repeated description of features of the coil electronic component according to an exemplary embodiment of the present disclosure described above will be omitted here.

As set forth above, according to an exemplary embodiment in the present disclosure, the coil electronic component which meets the demand for high inductance and low DC resistance by increasing the aspect ratio of the coil and making flow of magnetic flux generated by the coil smooth is provided.

While exemplary embodiments have been shown and described above, it will be apparent to those skilled in the art that modifications and variations could be made without departing from the scope of the present disclosure as defined by the appended claims.

What is claimed is:

1. A coil electronic component comprising:

a body including a support member, an internal coil supported by the support member, and an encapsulant encapsulating the support member and the internal coil; and external electrodes disposed on an external surface of the body and connected to the internal coil, wherein the internal coil includes a plurality of coil patterns, each of the plurality of coil patterns includes a lower coil pattern in contact with the support member and an upper coil pattern disposed on the lower coil pattern, a line width and a thickness of the lower coil pattern are uniform along the internal coil, and a line width and a thickness of the upper coil pattern increases in a direction from the center of the internal coil to the outermost portion of the internal coil.

2. The coil electronic component of claim 1, wherein a cross-section of the upper coil pattern and a cross-section of the lower coil pattern have a rectangular shape.

3. The coil electronic component of claim 1, wherein the lower coil pattern includes a seed layer and a plating layer.

4. The coil electronic component of claim 3, wherein a line width of the seed layer and a line width of the plating layer are equal.

5. The coil electronic component of claim 1, wherein an insulating layer is further disposed on a surface of the internal coil.

6. The coil electronic component of claim 1, wherein the line width of the upper coil pattern is narrower than or equal to the line width of the lower coil pattern disposed therebelow.

7. The coil electronic component of claim 1, wherein the support member includes a through-hole and a via hole spaced apart from the through-hole.

8. The coil electronic component of claim 7, wherein the through-hole is filled with the encapsulant.

9. The coil electronic component of claim 1, wherein the internal coil includes a first coil on one surface of the support member and a second coil on another surface of the support member.

10. The coil electronic component of claim 9, wherein the first coil and the second coil are symmetrical with respect to the support member.

11. A coil electronic component comprising:

a body including a support member, an internal coil supported by the support member, and an encapsulant encapsulating the support member and the internal coil; and external electrodes disposed on an external surface of the body and connected to the internal coil, wherein the internal coil includes a plurality of coil patterns each having a cross-section in a step shape, an upper portion of each of the plurality of coil patterns, which is in a farther side from the support member, has a line width different than a line width at a lower portion of each of the plurality of coil patterns, which is in a closer side from the support member, the line width at the upper portion of each of the plurality of coil patterns increases in a direction from the center of the internal coil to the outermost portion of the internal coil, and a thickness of each of the plurality of coil patterns increases in the direction from the center of the internal coil to the outermost portion of the internal coil.

12. The coil electronic component of claim 11, wherein the line width of at the lower portion of each of the plurality of coil patterns is uniform along the internal coil.

13. The coil electronic component of claim 11, wherein the line width at the upper portion of each of the plurality of coil patterns is narrower than the line width at the lower portion of each of the plurality of coil patterns.

14. The coil electronic component of claim 11, wherein an insulating layer is further disposed on a surface of the internal coil.

15. The coil electronic component of claim 11, wherein the support member includes a through-hole and a via hole spaced apart from the through-hole.

16. The coil electronic component of claim 15, wherein the through-hole is filled with the encapsulant.

17. The coil electronic component of claim 11, wherein the internal coil includes a first coil on one surface of the support member and a second coil on another surface of the support member.

18. The coil electronic component of claim 17, wherein the first coil and the second coil are symmetrical with respect to the support member.

* * * * *